US011131157B2

(12) United States Patent
Keith et al.

(10) Patent No.: US 11,131,157 B2
(45) Date of Patent: Sep. 28, 2021

(54) SYSTEM AND METHOD OF MANAGED PRESSURE DRILLING

(71) Applicant: NABORS DRILLING TECHNOLOGIES USA, INC., Houston, TX (US)

(72) Inventors: Adam Keith, Spring, TX (US); Danny Spencer, Houston, TX (US); Andre Perales, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 145 days.

(21) Appl. No.: 16/447,715

(22) Filed: Jun. 20, 2019

(65) Prior Publication Data

US 2019/0390525 A1 Dec. 26, 2019

Related U.S. Application Data

(60) Provisional application No. 62/688,824, filed on Jun. 22, 2018.

(51) Int. Cl.

| | |
|---|---|
| ***E21B 21/08*** | (2006.01) |
| *E21B 47/10* | (2012.01) |
| *E21B 47/06* | (2012.01) |
| *E21B 47/07* | (2012.01) |

(52) U.S. Cl.

CPC ..... *E21B 21/08* (2013.01); *E21B 47/06* (2013.01); *E21B 47/07* (2020.05); *E21B 47/10* (2013.01)

(58) Field of Classification Search

None

See application file for complete search history.

(56) References Cited

U.S. PATENT DOCUMENTS

| | | | | |
|---|---|---|---|---|
| 6,484,816 | B1 | 11/2002 | Koederitz | |
| 6,868,920 | B2 | 3/2005 | Hoteit et al. | |
| 2011/0042076 | A1* | 2/2011 | Reitsma | E21B 21/08 166/250.01 |
| 2015/0218931 | A1 | 8/2015 | Skinner | |
| 2016/0097270 | A1 | 4/2016 | Pobedinski et al. | |
| 2016/0298401 | A1 | 10/2016 | Cotton et al. | |
| 2016/0376859 | A1 | 12/2016 | Mehrabian et al. | |
| 2017/0228661 | A1 | 8/2017 | Chein et al. | |
| 2018/0230780 | A1* | 8/2018 | Klenner | G05B 19/41865 |

FOREIGN PATENT DOCUMENTS

| | | | |
|---|---|---|---|
| GB | 2544831 | A | 5/2016 |
| WO | 2017/035041 | A1 | 3/2017 |

* cited by examiner

*Primary Examiner* — Sean D Andrish

(74) *Attorney, Agent, or Firm* — Abel Schillinger, LLP; Enrique Abarca

(57) ABSTRACT

A system and method for conducting subterranean operations. In an embodiment, the system can include a monitoring system configured to monitor at least one criterion of a plurality of operational systems selected from the group of choke valves, mud pumps, drawworks, backpressure pumps, top drive, mud gas separator, flow line, blowout preventer, inside blowout preventer, or any combination thereof, and a logic device configured to generate a capacity value for each operational system of the plurality of the operational systems based on the at least one criterion, and further configured to change a state of one or more of plurality of the operational systems to control a downhole pressure.

19 Claims, 10 Drawing Sheets

SYSTEM AND METHOD OF MANAGED PRESSURE DRILLING

CROSS-REFERENCE TO RELATED APPLICATION

This application claims priority under 35 U.S.C. § 119(e) to U.S. Provisional Patent Application No. 62/688,824 entitled "System and Method of Managed Pressure Drilling", by Adam Keith, Danny Spencer & Andre Perales filed Jun. 22, 2018, which is assigned to the current assignee hereof and incorporated herein by reference in its entirety.

FIELD OF THE DISCLOSURE

The present disclosure relates to managed pressure drilling, and more particularly to systems and methods of controlling pressure while drilling.

RELATED ART

Managed pressure drilling (MPD) generally includes the circulation of drilling fluid through a wellbore annulus by surface backpressure. The drilling fluid is typically circulated through a closed-loop system and adjusted in response to pore pressure, formation fracture pressure, and annulus pressure throughout the wellbore, including as measured at a bottom hole assembly (BHA).

MPD systems improve drilling efficiency and operator safety. Thus, improvements in pressure management systems during drilling operations are desired by the oil and gas industry.

BRIEF DESCRIPTION OF THE DRAWINGS

Embodiments are illustrated by way of example and are not limited in the accompanying figures.

DETAILED DESCRIPTION

Figure 1:
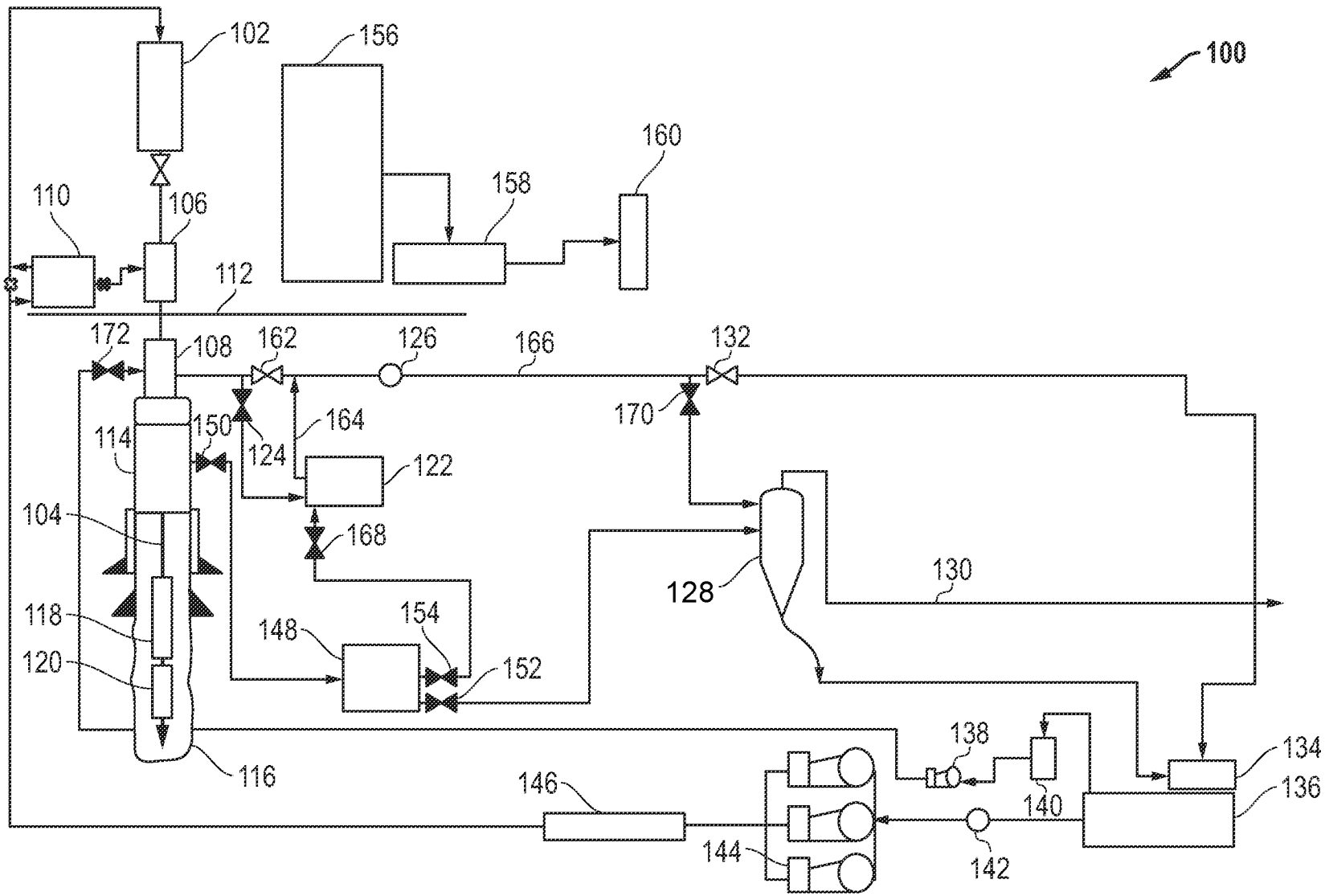
FIG. 1 includes a schematic of a system for conducting subterranean operations in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the drilling arts.

In accordance with an embodiment, a system for conducting subterranean operations can include a monitoring system configured to monitor at least one criterion of a plurality of operational systems selected from the group of choke valves, mud pumps, drawworks, backpressure pumps, top drive, mud gas separator, flow line, blowout preventer, inside blowout preventer, or any combination thereof. A logic device can be configured to generate a capacity value for each operational system of the plurality of the operational systems based on the at least one criterion, and further configured to change a state of one or more of plurality of the operational systems to control a downhole pressure.

In a particular embodiment, the at least one criterion is selected from the group of a wear status, a position, operational status, hydraulic modeling, sensor status, pressure, temperature, flow rate, density, rheology, or any combination thereof. The plurality of operational systems can be selected from the group including choke valves, mud pumps, backpressure pumps, blowout preventer, inside blowout preventer, and combinations thereof.

In another embodiment, a method of conducting subterranean operations includes monitoring at least one criterion of a plurality of operational systems selected from the group of choke valves, mud pumps, drawworks, backpressure pumps, top drive, mud gas separator, flow line, blowout preventer, inside blowout preventer, or any combination thereof and sending the at least one criterion to a logic device configured to generate a capacity value for each operational system based on the at least one criterion. The method can further include changing a state of one or more of the plurality of the operational systems to control a downhole pressure.

Referring to FIG. 1, a system 100 for conducting subterranean operations can include a drilling rig for example including a top drive 102 coupled to a drill string 104 extending into a wellbore 116. In an embodiment, the system 100 can include a nonstop drilling device (NSD) 106. In a further embodiment, the system 100 can include a rotating control device (RCD) 108.

The NSD 106 can be coupled with a manifold diverter 110. In an embodiment, the NSD 106 and manifold diverter 110 can be disposed above the surface 112 of the subterranean formation (e.g., above the ground or above the drill rig platform). The RCD 108 can be disposed below the surface 112.

A blowout preventer (BOP) 114 can be utilized in the system 100 to control formation fluids if control is lost by the drilling operators. In an embodiment, the BOP 114 includes a BOP stack including two or more BOPs. The BOP stack can include ram-type preventers and annular-type preventers.

One or more steering devices 118 can be disposed within the wellbore 116. A non-return valve (NRV) 120 can be utilized to reduce back pressure.

The RCD 108 can be coupled with a managed pressure drilling (MPD) choke 122. In an embodiment, the MPD choke 122 is spaced apart from the RCD 108 by a valve 124. In a particular embodiment, the valve 124 can be selected from a globe valve, a gate valve, a ball valve, a butterfly valve, a plug valve, a diaphragm valve, a check valve, a relief valve, a pinch valve, a needle valve, or any combination thereof. In certain instances, the valve 124 can be manually operated. In other instances, the valve 124 can be operated by a motor or actuator. The valve 124 can be controlled by a logic element or in communication with a device adapted to control operation of the valve 124. All valves described in accordance with embodiments herein can be selected, for example, from those described with respect to valve 124. In an embodiment, at least two valves of the system 100 can have a same type, capacity, control, operation, or any combination thereof. In a more particular embodiment, all of the valves in the system 100 can be identical. In another embodiment, at least two valves of the system 100 can be different from one another in type, capacity, control, operation, or a combination thereof.

In an embodiment, a valve 162 can be disposed along a line 166 extending from the RCD 108 at a location after the valve 124 but prior to connection with a return line 164 from MPD choke 122 to the line 166. In another embodiment, particularly in offshore applications, at least valves 124 and 162 can be optionally replaced by a buffer manifold (not illustrated) which can be coupled to the MGS 128, MPD choke 122, rig choke 148, or any combination thereof. The buffer manifold can control operational fluid flow through the system 100.

A sensor 126, such as a Coriolis flow line integrated sensor, can be disposed downstream of the MPD choke 122 on line 166. In an embodiment, the sensor 126 can be part of a manifold, or included in a manifold, such as an MPD manifold of the system 100.

Further downstream, a mud gas separator (MGS) 128 can separate mud and gases from returned from the wellbore 116. The MGS 128 can be on a line teed from the line 166. A valve 170 can be disposed between the line 166 and the MGS 128.

A vent line 130 can remove gas from the MGS 128 to a flare (not illustrated) where separated gases can be safely burned off at a location safely away from the drilling rig.

A valve 132 can be disposed on the line 166. The valve 132 can be positioned downstream of the MGS 128 and valve 170. When the valve 132 is closed, fluid can be diverted from the line 166 to the MGS 128.

Shakers 134 disposed downstream of MGS 128 can separate large solids (cuttings) from drilling fluid (mud). Mud separated from the shakers 134 can enter a mud system 136 including, for example, mud pits, reserve pits, mud storage components, mud pumps, tubing, additional separators or degassers, or any combination thereof. The mud system 136 can manage drilling mud that can be returned to the wellbore 116 for managed pressure drilling operations.

The shakers 134 can also be connected to the line 166 directly through valve 132. That is, for example, when valve 132 is open, fluid can bypass the MGS 128. In a more particular embodiment, the drilling fluid can circulate directly to the shakers 134 through the valve 132 from the sensor 126.

A trip pump 138 can pump mud from the mud system 136 to the wellbore 116, such as to the RCD 108. In an embodiment, the trip pump 138 can be spaced apart from the mud system 136 by a trip tank 140. The trip tank 140 can track volume of mud replacing volume of the drill string, volume gain, used to determine well condition under static condition, or a combination thereof.

A valve 172 can be disposed between the trip pump 138 and the RCD 108.

In an embodiment, the mud system 136 can be in fluid communication with the manifold diverter 110. A sensor 142 can be disposed between the mud system 136 and the manifold diverter 110. The sensor 142 can include, for example, a Coriolis flow meter. One or more pumps 144 can be disposed between the mud system 136 and the manifold diverter 110. In an embodiment, the one or more pumps 144 can include one or more mud pumps. In another embodiment, the one or more pumps 144 can include one or more backpressure pumps. The backpressure pump can be used to maintain backpressure in the system 100, for example, during pipe attachment. In yet a further embodiment, the one or more pumps 144 can include at least one mud pump and at least one backpressure pump.

A rig stand pipe 146 can be disposed between the mud system 136 and the manifold diverter 110.

A rig choke 148 can be disposed between the BOP 114 and the MPD choke 122. In an embodiment a valve 150 can be disposed between the BOP 114 and the rig choke 148. The rig choke 148 can be in fluid communication with the MGS 128. A valve 152 can be disposed between the rig choke 148 and the MGS 128. A valve 154 can be disposed between the MPD choke 122 and the rig choke 148. In certain embodiments, a valve 168 can also be employed between the rig choke 148 and the MPD choke 122. In a particular embodiment, the valves 154 and 168 are different in type, size, capacity, or any combination thereof.

In an embodiment, the system 100 can further include a human-machine-interface (HMI) 156 adapted to facilitate control of the system 100, provide data, software, modeling, prediction, simulation, detection, or any combination thereof to a human. In an embodiment, the HMI 156 is in communication with a local logic device 158. The local logic device can be at the site of the drilling rig or spaced apart therefrom. In an embodiment, the local logic device 158 is adapted to be controlled by a drilling operator on site.

In another embodiment, the HMI 156 is wirelessly coupled with a logic device by a remote connection, such as through a satellite 160. The satellite 160 can relay the HMI signal to a drilling operator remotely positioned relative to the drilling rig.

Figure 2:
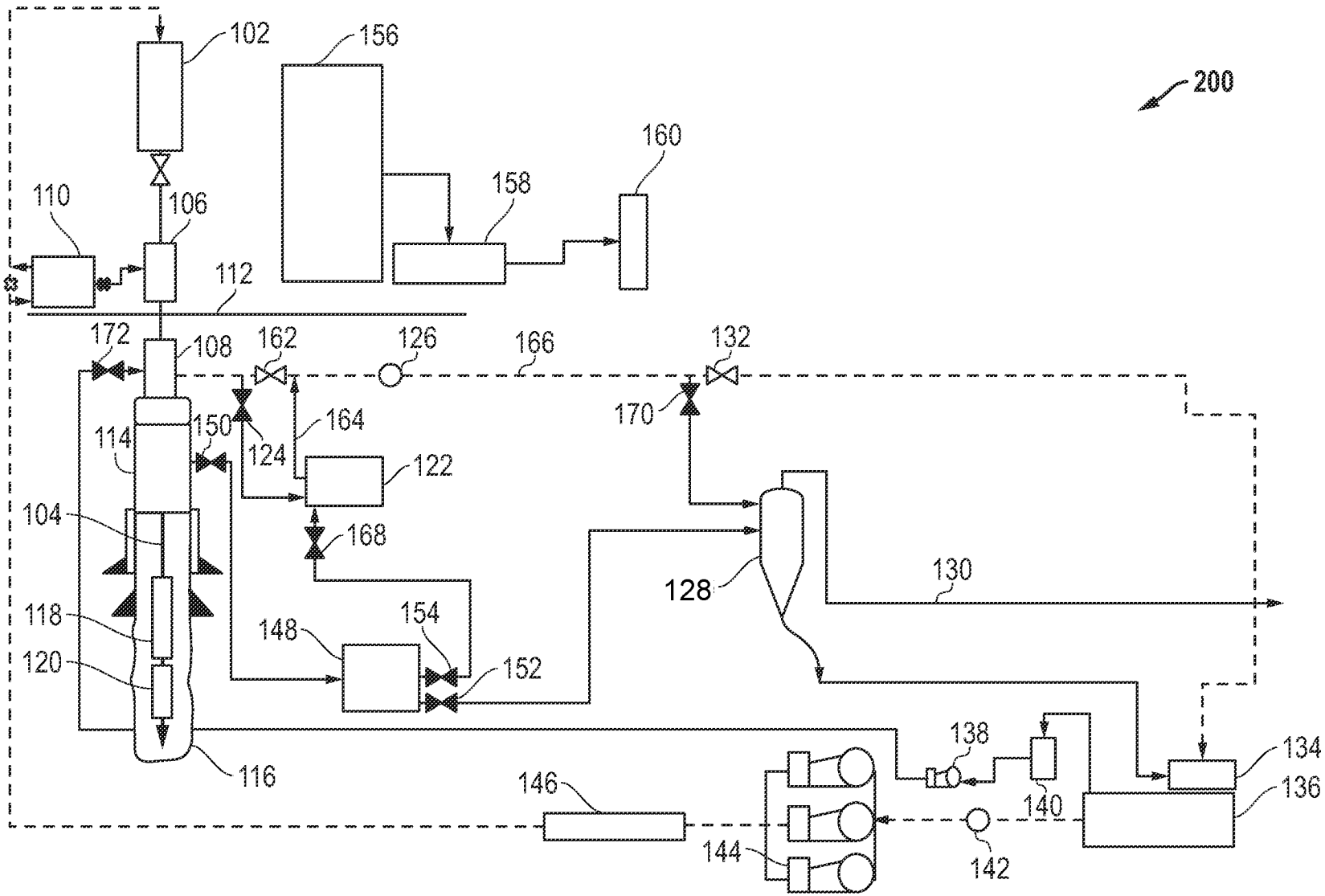
FIG. 2 includes a schematic of a system for conducting subterranean operations in accordance with an embodiment.

FIG. 2 includes a schematic illustration of a system 200 for subterranean operations adapted for predictive drilling operations, such as for example, early kick/loss detection. As illustrated, fluid flow from the RCD 108 passes through valves 162 and 132 to the shaker 134. From the shaker 134, fluid flow continues through the mud system 136 and is circulated to the top drive 102. For understanding, movement of fluids is indicated by dashed lines and open valves.

Figure 3:
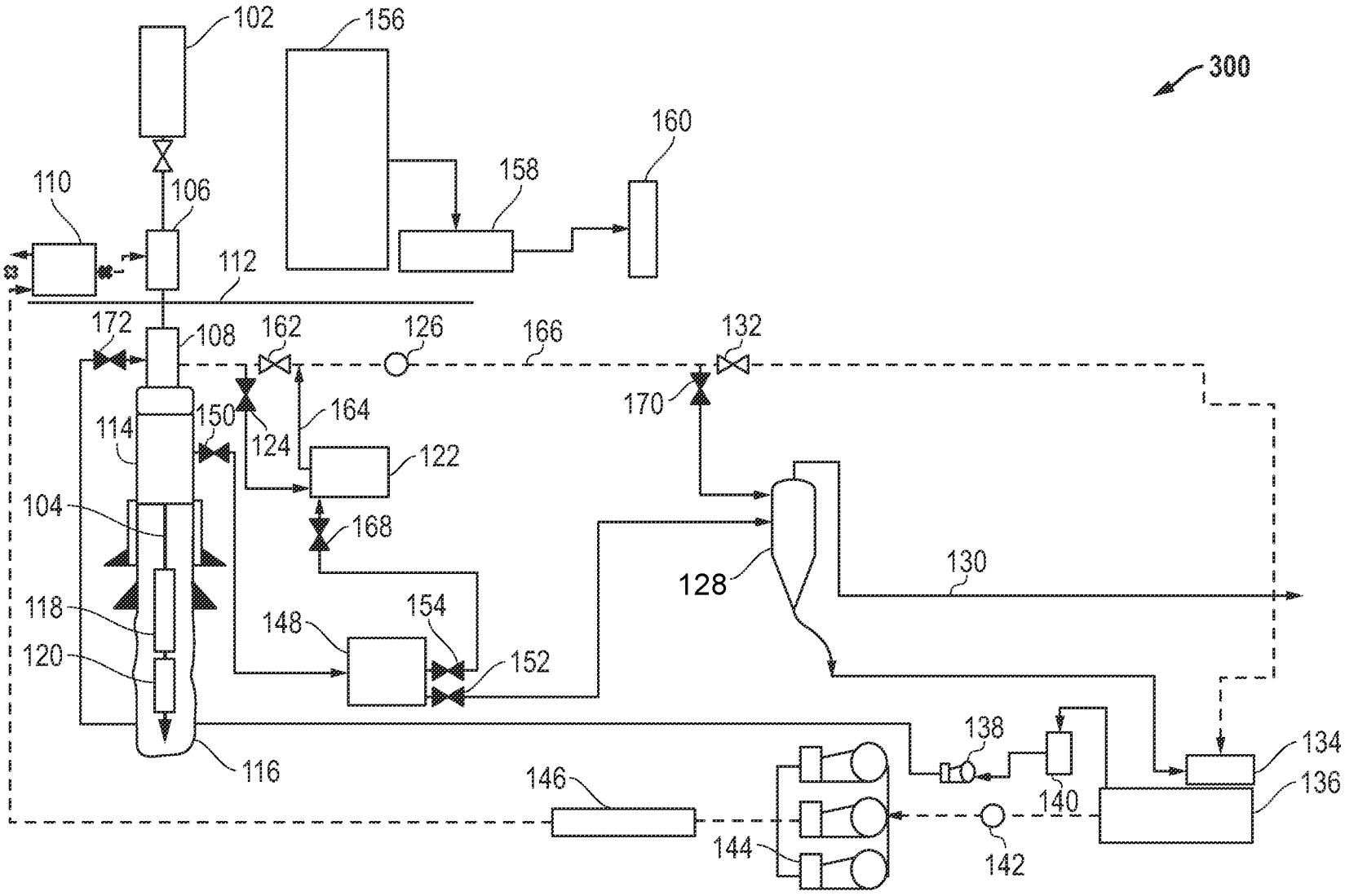
FIG. 3 includes a schematic of a system for conducting subterranean operations in accordance with an embodiment.

FIG. 3 includes a schematic illustration of a system 300 adapted for NSD connection. In this configuration the system 300 is adapted to provide enhanced well cleaning and equivalent circulating density (ECD) management. Similar to the system 200 illustrated in FIG. 2, fluid flow from the RCD 108 can pass through valves 162 and 132 to the shaker 134. The fluid flow from the shaker 134 can move through the mud system 136 to the manifold diverter 110 and to the NSD 106.

Figure 4:
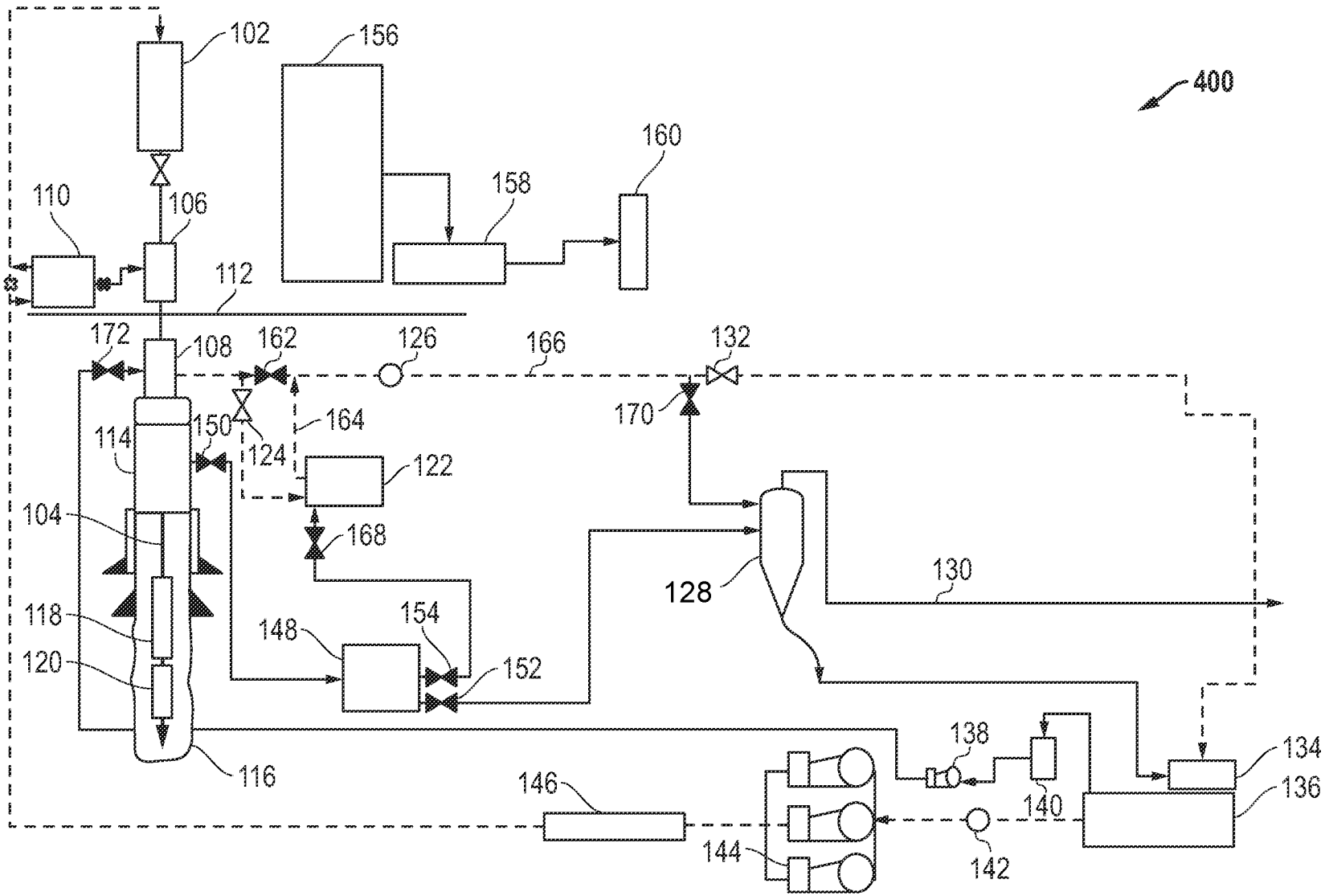
FIG. 4 includes a schematic of a system for conducting subterranean operations in accordance with an embodiment.

FIG. 4 includes a schematic illustration of a system 400 adapted for drilling hazards. This may be useful during wellbore ballooning, early kick/loss detection, wellbore breathing, occurrence of connection gas, entrained gas, fluid losses, and influx. By way of non-limited example, if the system 400 detects influx or similar potential drilling hazard requiring well control, the system 100 can turn off pumps like pump 104 and direct fluid to chokes (like MPD choke). The system 400 can also raise the drawworks to pick up the drill string off bottom, removing Weight On Bit (WOB), detecting/ensuring that a tool joint is not positioned across any annular-closing devices ("spacing out"), stopping top drive 102 rotation, closing the appropriate annular isolating device such as the annular preventer or a set of blind/shear ram preventers, redirecting the fluid path through the well control manifold and shutting the well control chokes (if not already closed) to the MGS 128, automatically sequentially or simultaneously, when applicable. In certain embodiments, kicks can be initially suppressed using the MPD choke 122. Another example, as the influx is circulated and gas breaks out of solution and begins to expand, it may be necessary to gradually close the choke to hold constant drill pipe pressure and prevent excessive unloading of the drilling fluid from the annulus. The maximum operating pressure of the atmospheric MGS 128 is set by the depth of the liquid seal placed in the ground downstream of the separator and the density of the drilling fluid. The liquid seal can be automatically adjusted. Other examples without limitation may include, MPD influx/losses management, conventional well control and killing operations, preventing MGS blow-through, stripping operations, connection processes, pump cycling schedules, cementing, equipment efficiency and fingerprinting calibrations, downhole or otherwise, and drilling processes.

In the system 400 illustrated in FIG. 4, fluid flow from the RCD 108 passes through valve 124 to the MPD choke 122. Valve 162 disposed along line 166 can be in the closed configuration. Fluid can then reenter the line 166 and move to shaker 134. The fluid can then be circulated to the top drive 102.

Figure 5:
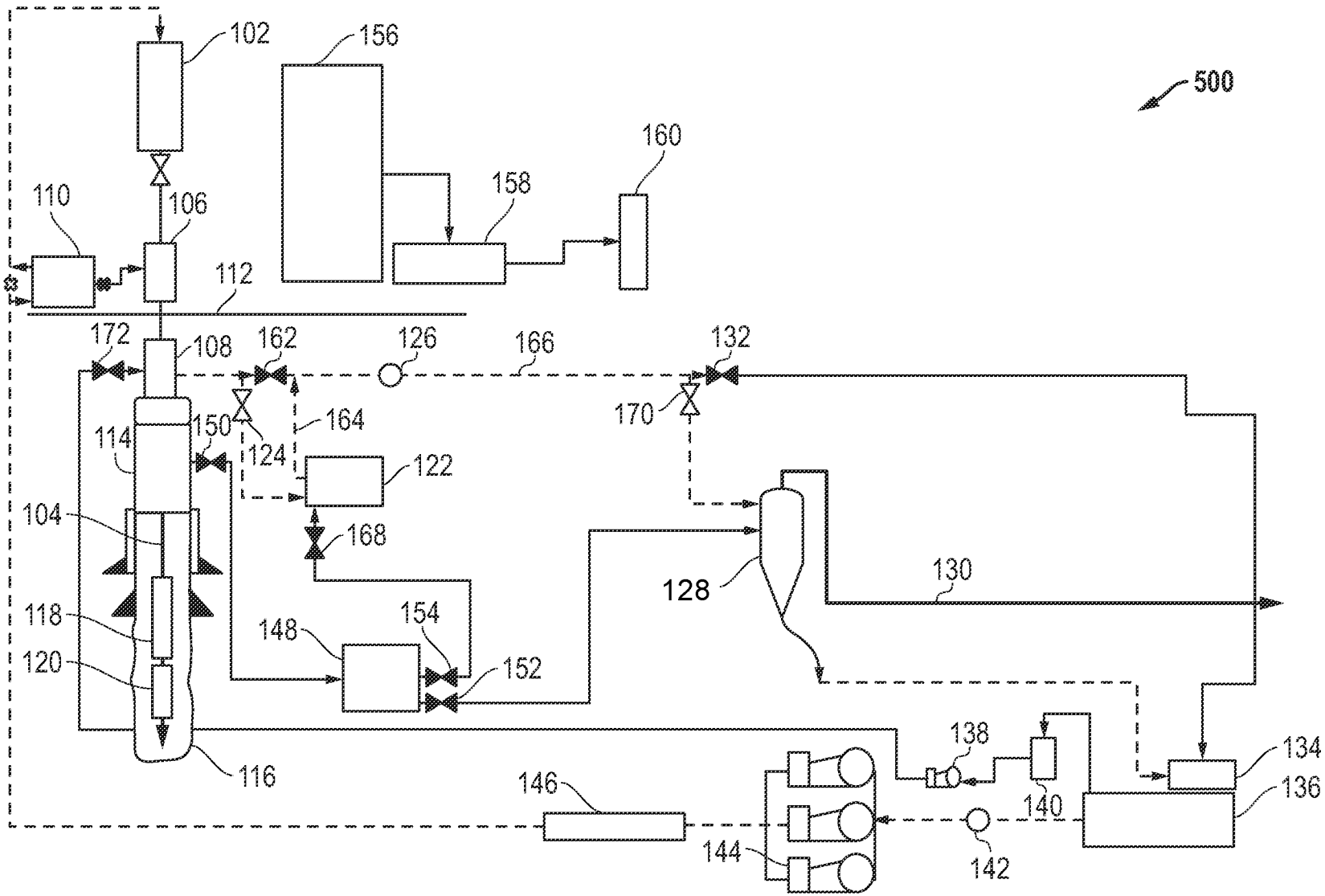
FIG. 5 includes a schematic of a system for conducting subterranean operations in accordance with an embodiment.

FIG. 5 includes another schematic illustration of a system 500 adapted for drilling hazards. Fluid flow from the RCD 108 passes through valve 124 into MPD choke 122. Unlike the system 400 illustrated in FIG. 4, drilling fluid is diverted from line 166 to MGS 128. Valve 170 can be open and valve 132 can be closed. The MGS 128 separates mud and gases. Gasses are diverted to vent line 130 where they are directed towards a flare for burning off. Meanwhile mud is passed to shaker 134 where mud and cuttings are separated. The mud is then returned to the top drive 102 in a manner similar to the embodiment illustrated in FIG. 4.

Figure 6:
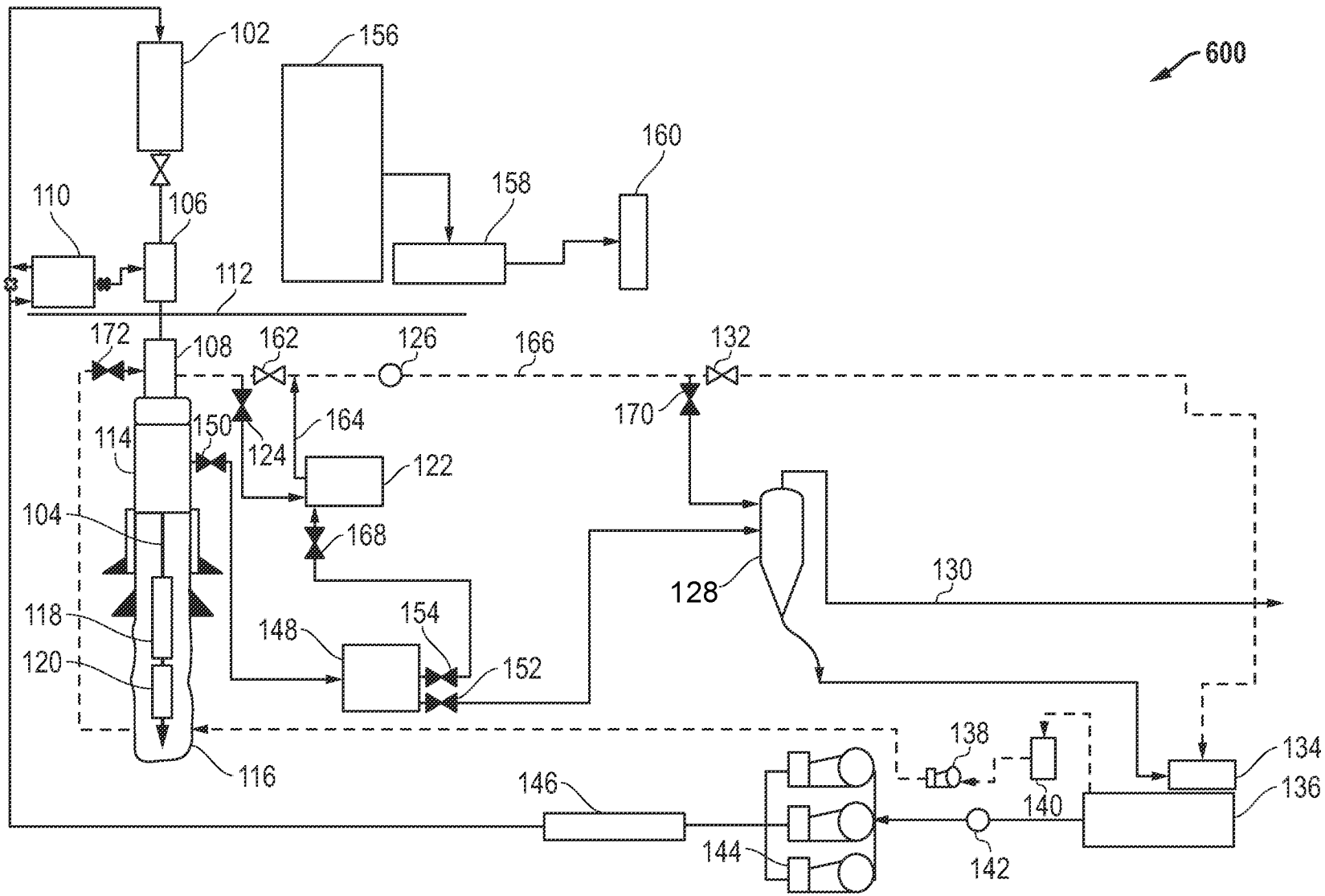
FIG. 6 includes a schematic of a system for conducting subterranean operations in accordance with an embodiment.

FIG. 6 includes a schematic illustration of a system 600 adapted for tripping operations. In the illustrated embodiment, fluid flow from the RCD 108 passes through valve 162 to the shaker 134. From the shaker 134, mud moves to the mud system 136. Mud from the mud system 136 is then circulated through the trip tank 140 and trip pump 138 back to the RCD 108. The use of embodiments of systems 600 during tripping operations can track fluid displacement and fill the well as necessary for proper managed pressure drilling during tripping operations.

Figure 7:
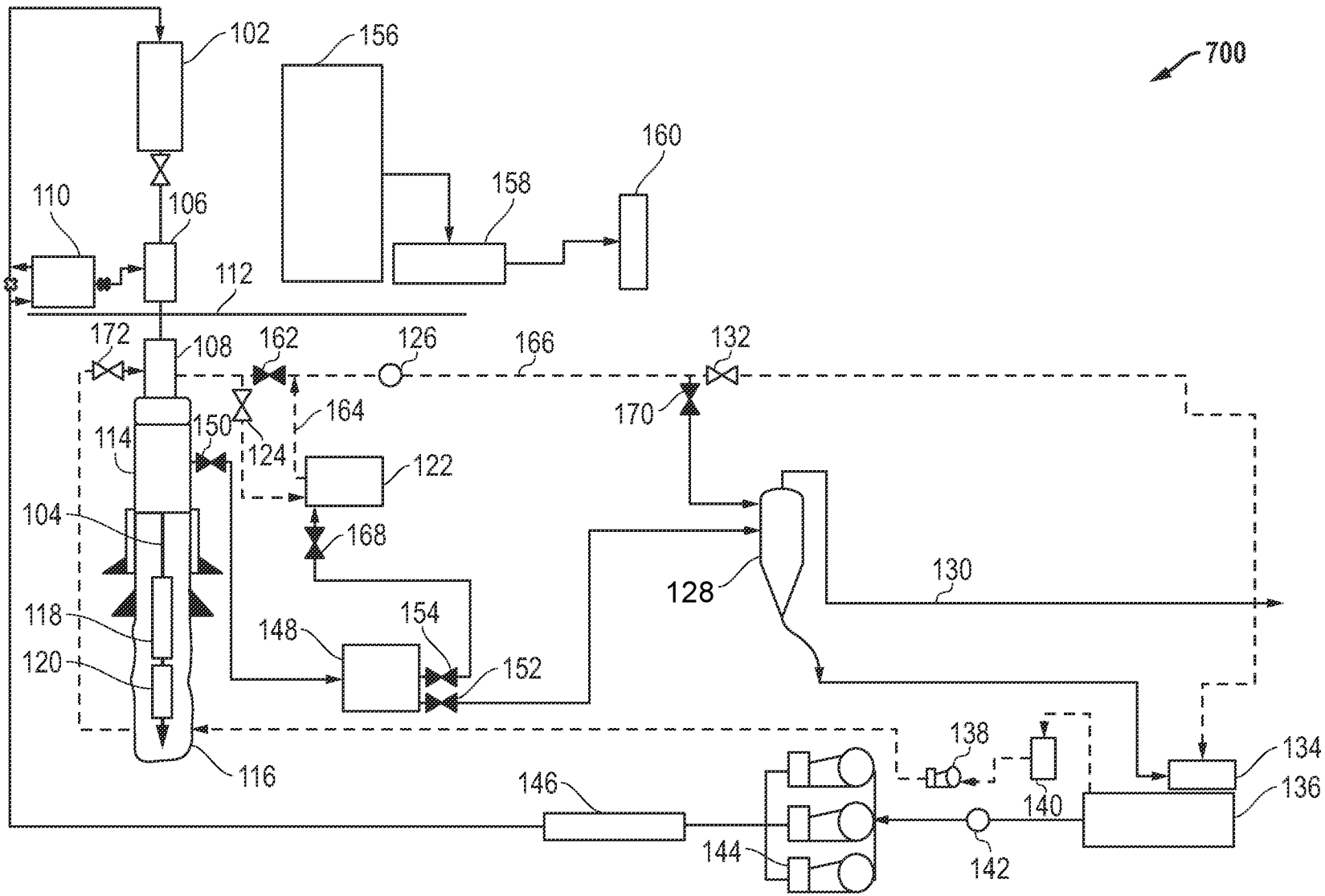
FIG. 7 includes a schematic of a system for conducting subterranean operations in accordance with an embodiment.

FIG. 7 includes another schematic illustration of a system 700 adapted for tripping operations. Unlike the system 600 illustrated in FIG. 6, drilling fluid is circulated through MPD choke 122 before returning to line 166 on its way to shakers 134. The use of the system 700 can compensate for surge/swab that might be needed during drilling operations. Surge events are characterized by an increase in bottom hole pressure due to the movement of the drill string into the wellbore and static drilling mud. In response to surge events, the system 600 can detect and control any one or combination of the MPD choke 122, the drawworks (not illustrated), and pumps 144. A swab event is characterized by a bottom hole pressure decrease due to the movement of the drill string out of the wellbore 116 and static drilling mud. In response to swab events, the system 600 can detect and control any one or combination of the MPD choke 122, the drawworks, and pumps 144.

Figure 8:
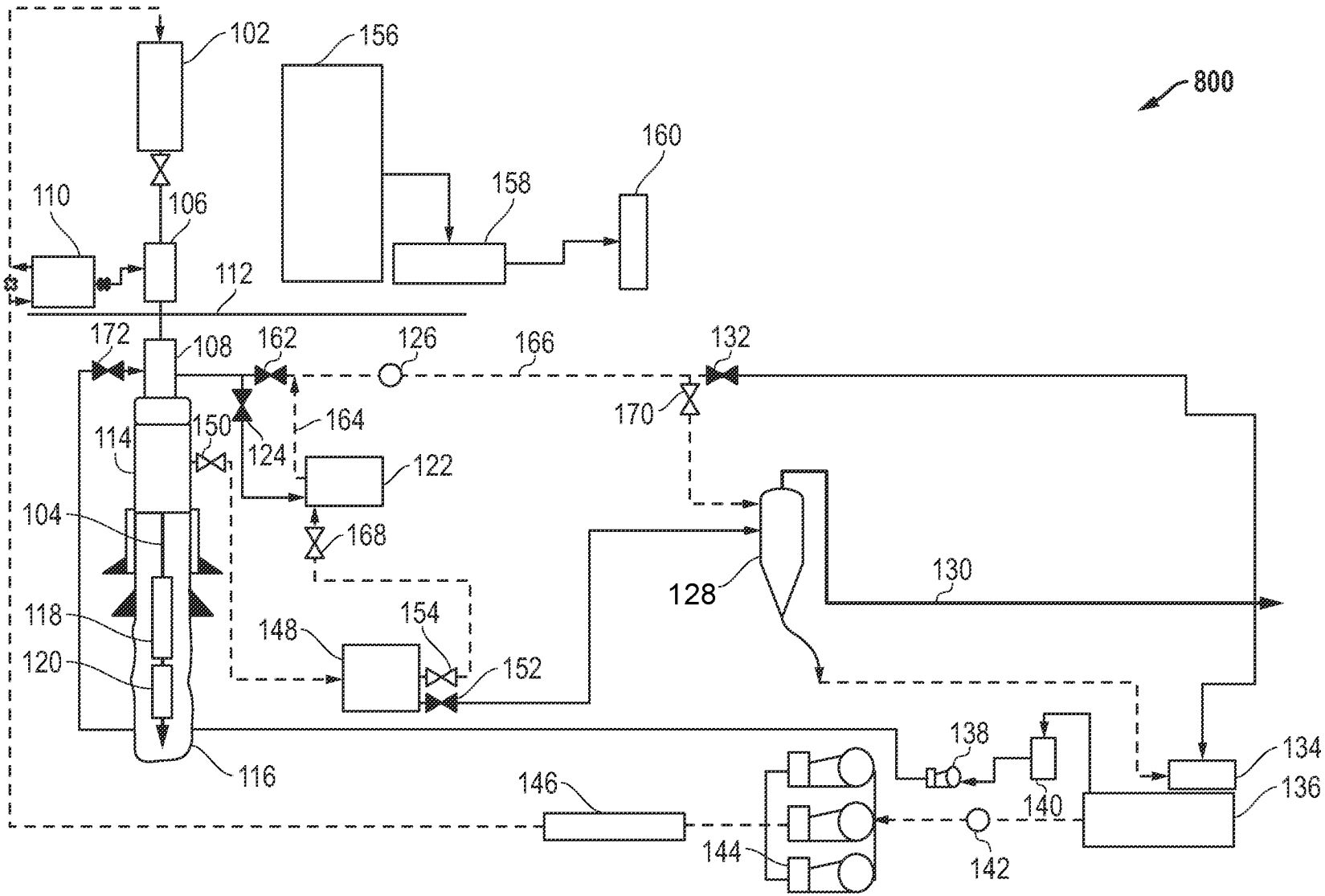
FIG. 8 includes a schematic of a system for conducting subterranean operations in accordance with an embodiment.

FIG. 8 includes a schematic illustration of a system 800 adapted for well control. During well control, the system 800 can exceed MPD matrix, isolate RCD equipment, and use MPD choke 122 for stand pipe pressure control. In the system 800, fluid flow from the BOP 114 passes through valve 150 to rig choke 148. Fluid can then pass through valve 154 (and optionally valve 168) to MPD choke 122. From the MPD choke 122, fluid passes through sensor 126 and is diverted to the MGS 128. Flare line 130 can vent gas from the MGS 128. Other fluids are circulated to the shakers 134 and diverted to the top drive 102.

Figure 9:
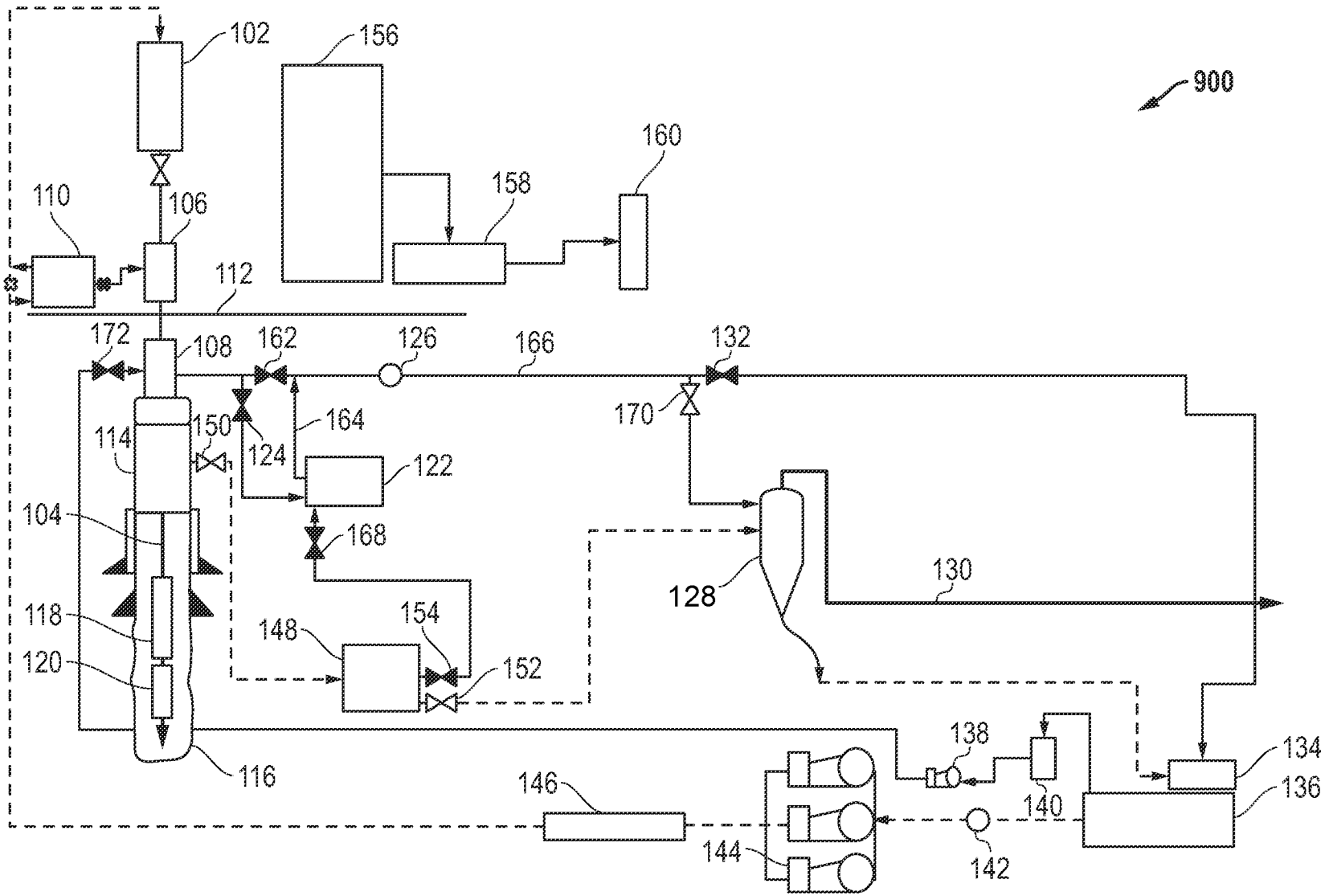
FIG. 9 includes a schematic of a system for conducting subterranean operations in accordance with an embodiment.

FIG. 9 includes another schematic illustration of a system 900 adapted for well control. The system 900 can exceed MPD matrix, isolate surface equipment, and has a high kick tolerance. Fluid from the BOP 114 is diverted to the rig choke 148. Valve 152 is open, permitting passage of fluid from the rig choke 148 to the MGS 128. From MGS 128 fluid can pass to the shakers 134, mud system 136, flow sensor 142, pumps 144, rig stand pipe 146 and back to the top drive 102.

It should be understood that the above exemplary embodiments illustrate methods of managing pressure during drilling operations, such as before, during and after kicks, during tripping operations, during wellbore changes like ballooning and breathing, and during NSD setup. Skilled artisans will appreciate after reading this specification that other combinations of valves, equipment, and sensors can be disposed in the systems to adjust operational capacity thereof. Moreover, the equipment herein described can be altered or used in various different combinations to permit enhanced drilling operations.

Figure 10:
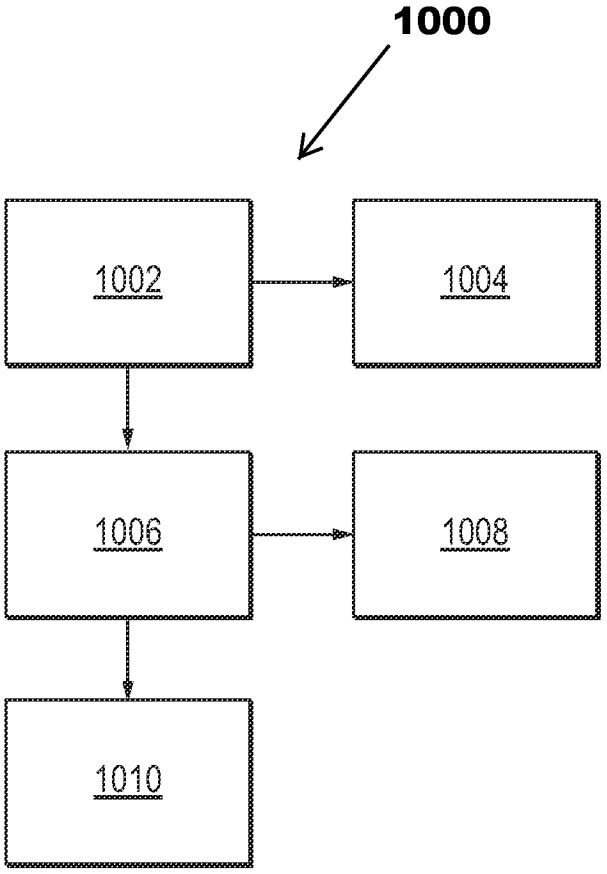
FIG. 10 includes a schematic illustration of a system for conducting subterranean operations in accordance with an embodiment.

FIG. 10 includes a schematic illustration of a system 1000 for conducting subterranean operations. The system 1000 can include a monitoring system 1002 configured to monitor at least one criterion of a plurality of operational systems 1004 selected from the group of choke valves, mud pumps, drawworks, backpressure pumps, top drive, mud gas separator, flow line, blowout preventer, inside blowout preventer, or any combination thereof.

The plurality of operational systems 1004 can include any one of the previously described equipment. For example, in a particular embodiment, choke valves can include any one or more of valves 162, 124, 150, 172, 152, 154, 168, 132, and 170. In another particular embodiment, mud pumps can include pumps 138 and 144. In yet a further embodiment, top drives can include top drive 102. In another embodiment, mud gas separator can include MGS 128. In yet another embodiment, blowout preventer can include BOP 114.

The at least one criterion can be selected from the group of a wear status, a position, an operational status, hydraulic modeling, sensor status, pressure, temperature, flow rate, density, rheology, or any combination thereof. Wear status can be indicative of the wear of the operational system 1004. Wear status can identify effective operational ability of the operational system 1004 instead of ideal or original condition. For example, valves can begin to fail during operational lifespan causing different flow rate characteristics or altering flow rate altogether. Similarly, chokes, pumps, sensors, and other equipment in the systems described herein can exhibit different parameter operational capacity in response to aging. Position can refer to the position of the operational system 1004, such as valve positions and choke throttling. Thus, the valve can be monitored to determine whether open or closed and the choke can be monitored to determine the relative openness thereof. Operational status can refer, for example, to whether an operational system 1004 is on or off, open or closed, in service or out of service, or any combination thereof. For example, as certain operational systems 1004 of the system 1000 are replaced, that operational status of said operational system 1004 is out of service.

In an embodiment, the monitoring system 1002 can be selected from the group consisting of pressure sensors, flow sensors, RPM indicators, weight indicators, choke position indicators, PVT (pit-volume totalizer) systems, downhole sensors, and combinations thereof. In a particular embodiment, the monitoring system 1002 can include a plurality of systems, such as for example, a plurality of pressure and flow sensors, downhole sensors, and choke position indicators.

In an embodiment, the system 1000 is interconnected by a plurality of flow lines (such as line 166) configured to contain fluids. The monitoring system 1002 can be configured to measure characteristics of the fluids within the flow lines. For example, the monitoring system 1002 can measure the pressure within each of the flow lines.

In a particular instance, the monitoring system 1002 can be configured to send data to a logic device 1006 of the system 1000. For example, the monitoring system 1002 can monitor pressure of fluid within the flow lines and send the pressure data to the logic device 1006.

In an embodiment, the logic device 1006 is configured to generate a capacity value for each operational system of the plurality of operational systems 1004 based on the at least one criterion. As used herein, "capacity value" refers to a total operational capacity the operational system 1004. For example, if a perfectly-operating operational system 1004 has an operational capacity of 100%, a worn or out of position operational system 1004 might have an operational capacity of 95%. That is, the worn operational system 1004 may have a total operational capacity, or capacity value, different than that of a perfectly operating operational system 1004.

In an embodiment, the logic device 1006 is further configured to change a state of one or more of the plurality of operational systems 1004. For example, the logic device 1006 can control the relative position of a valve of the system 1000 to operation thereof. In a particular embodiment, the logic device 1006 is configured to change the state of one or more of the plurality of operational systems 1004 to control pressure in the wellbore 116 (downhole pressure).

In a particular instance, the logic device 1006 can be configured to compare the capacity value of at least one of the operational systems 1004 to data and develop an operational model for managed pressure drilling. In a more particular embodiment, the logic device 1006 can be configured to compare the capacity value of each of the operational systems 1004 to the pressure data and develop an operational model configured to control downhole pressure.

In an embodiment, the operational model can include changes to one or more operational systems 1004 to control the downhole pressure for one or more drilling events. The one or more drilling events can be selected from the group consisting of a stuck pipe-packoff, stuck pipe-hole collapse, a differentially stuck pipe, a power loss, a mud gas separator high fluid level, a mud gas separator blow through, RCD RPM exceeding RPM rating, tripping, connecting pipe, a surge, a swab, or any combination thereof, or any combination thereof.

The logic device 1006 can be configured to send one or more instructions to a controller 1008. In an embodiment, the one or more instructions are based on the operational model. The controller 1008 can be configured to change a state of at least one of the operational systems 1004 based on the instructions.

In an embodiment, the controller 1008 can be configured to change the state of at least one of the operational systems 1004 based on a process schedule. The controller 1008 can send a process signal to the logic device 1006. The process signal can include, such as contain, information identifying a scheduled process. The logic device 1006 can generate an operational model based on the process signal. The logic device 1006 can further generate a capacity value of the operational systems 1004. In an embodiment, the logic device 1006 can be configured to send an instruction to the controller 1008 to change the state of one or more operational systems 1004 during the scheduled process. In another embodiment, the logic device 1006 can be configured to send an operational model to the controller 1008 and the controller can be configured to change the state of one or more operational systems 1004 as indicated by the operational model during the scheduled process. In yet another embodiment, the logic device 1006 is configured to send the operational model to an interface 1010, such as HMI 156, for review by a human operator. The controller 1008 can be configured to change states of the operational systems 1004 according to the operational model unless the operational model is aborted by the human operator.

In a particular instance, the logic device 1006 can be configured to predict a change in bottom hole pressure based on pressure data or real time hydraulics. The logic device 1006 can further be configured to generate an operational model based on a predicted change in bottom hole pressure. In an embodiment, the logic device is configured to send an instruction to the controller 1008 based on the operational model. The controller 1008 can be configured to change the state of one or more operational systems 1004 in accordance with the instruction. The logic device 1006 can also be configured to send the operational model to the controller 1008 which can change the state of the one or more operational systems according to the instruction.

In another instance, the logic device 1006 can be configured to predict a change in bottom hole pressure. The predicted change can be done by comparing pressure data to historical pressure data. In an embodiment, historical pressure data can be stored on a memory device (not illustrated). The logic device 1006 can be configured to access the historical pressure data from the memory device.

By way of non-limiting example, prior to connecting pipe to the drill string, the system 1000 must absorb additional backpressure. One or more operational systems 1004, such as chokes and pumps, can be adjusted to increase surface backpressure. The controller 1008 can automatically adjust the one or more chokes or pumps in relation to one another with reference to their capacity values. So, for instance, if a choke has a 95% capacity value due to premature wear, the controller 1008 can increase reliance on the pumps in maintaining the back pressure. The pumps can be ramped down to 0 gallons per minute (GPM). When ready to make the connection the controller 1008 can ramp down system pressure. Simultaneously, based on historical data, calculations, or a combination thereof, the controller 1008 can close the chokes to simultaneously control surface backpressure in a deliberate manner at a deliberate position according to a pre-planned MPD schedule. The controller 1008 continues to check for operational anomalies, for example pressure change, flow discrepancies, gas, etc, and adjustments can be made by altering the pumps, chokes, and combinations thereof. After the pipe is connected, the process can repeat in reverse.

In an embodiment, the controller 1008 can be an integrated controller with the drilling rig, allowing a rig operator access to the system 1000. By way of non-limiting example, the rig operator can manage the MPD choke 122 as well as other operational systems of the system. In an embodiment, the controller 1008 or a component attached thereto, can affect control of a drawworks, top drive, BOP controller, mud pumps, other equipment, or any combination thereof.

Figure 11:
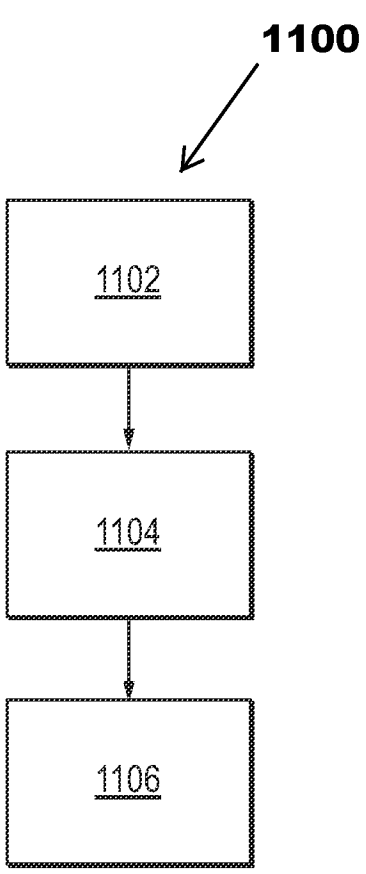
FIG. 11 includes a flow chart of a method of conducting subterranean operations in accordance with an embodiment.

FIG. 11 includes a flow chart of a method 1100 of conducting subterranean operations in accordance with an embodiment. The method includes monitoring 1102 at least one criterion of a plurality of operational systems selected from the group of choke valves, mud pumps, drawworks, backpressure pumps, top drive, mud gas separator, flow line, blowout preventer, inside blowout preventer, or any combination thereof. The method can further include sending 1104 the at least one criterion to a logic device configured to generate a capacity value for each operational system based on the at least one criterion. The method can additional include changing 1106 a state of one or more of the plurality of the operational systems to control a downhole pressure.

Embodiments described herein are adapted to permit enhanced managed pressure drilling control and predictive capability through automated work flows that quickly take action to mitigated undesired and/or dangerous events. In other embodiments, the system can increase accuracy, reliability, and/or smoothness of wellbore operations.

The present invention has broad applicability and can provide many benefits as described and shown in the examples above. The embodiments will vary greatly depending upon the specific application, and not every embodiment will provide all of the benefits and meet all of the objectives that are achievable by the invention. Note that not all of the activities described above in the general description or the examples are required, that a portion of a specific activity may not be required, and that one or more further activities may be performed in addition to those described. Still further, the order in which activities are listed are not necessarily the order in which they are performed.

Embodiment 1

A system for conducting subterranean operations comprising:

a monitoring system configured to monitor at least one criterion of a plurality of operational systems selected from the group of choke valves, mud pumps, drawworks, backpressure pumps, top drive, mud gas separator, flow line, blowout preventer, inside blowout preventer, or any combination thereof; and a logic device configured to generate a capacity value for each operational system of the plurality of the operational systems based on the at least one criterion, and further configured to change a state of one or more of plurality of the operational systems to control a downhole pressure.

Embodiment 2

The system of embodiment 1, wherein the at least one criterion is selected from the group of a wear status, a position, operational status, hydraulic modeling, sensor status, pressure, temperature, flow rate, density, rheology, or any combination thereof.

Embodiment 3

The system of embodiment 2, wherein the plurality of operational systems are selected from the group including choke valves, mud pumps, backpressure pumps, blowout preventer, inside blowout preventer, and combinations thereof.

Embodiment 4

The system of embodiment 1, wherein the monitoring system comprises a plurality of components selected from the group consisting of pressure sensors, flow sensors, RPM indicators, weight indicators, choke position indicators, PVT (pit-volume totalizer) system, downhole sensors, and combinations thereof.

Embodiment 5

The system of embodiment 1, further comprising a plurality of flow lines configured to contain fluids, and the monitoring system is configured to measure the pressure within each of the flow lines of the plurality of flow lines.

Embodiment 6

The system of embodiment 5, wherein the monitoring system is configured to send pressure data to the logic device, wherein the pressure data includes the measured pressure within each of the flow lines of the plurality of flow lines.

Embodiment 7

The system of embodiment 6, wherein the logic device is configured to compare the capacity value of each of the operational systems to the pressure data and develop an operational model, wherein the operational model is configured to control a downhole pressure.

Embodiment 8

The system of embodiment 7, wherein the operational model includes changes to one or more operational systems to control the downhole pressure for one or more drilling events.

Embodiment 9

The system of embodiment 8, wherein the one or more drilling events are selected from the group consisting of a stuck pipe-packoff, stuck pipe-hole collapse, a differentially stuck pipe, a power loss, a mud gas separator high fluid level, a mud gas separator blow through, RCD RPM exceeding RPM rating, tripping, connecting pipe, a surge, a swab, or any combination thereof.

Embodiment 10

The system of embodiment 7, wherein the logic device is configured to send one or more instructions to a controller based on the operational model.

Embodiment 11

The system of embodiment 10, wherein the controller is configured to change a state of at least one of the operational systems of the plurality of operational systems based on the instructions.

Embodiment 12

The system of embodiment 10, wherein the controller is configured to change a state of at least one of the operational systems of the plurality of operational systems based on a process schedule.

Embodiment 13

The system of embodiment 12, wherein the controller is configured to send a process signal to the logic device, wherein the process signal contains information identifying a scheduled process.

Embodiment 14

The system of embodiment 13, wherein the logic device is configured to generate an operational model based on the process signal and capacity value of the operational systems.

Embodiment 15

The system of embodiment 14, wherein the logic device is configured to send an instruction to the controller and the controller is configured to change the state of one or more operational systems during the scheduled process.

Embodiment 16

The system of embodiment 14, wherein the logic device is configured to send an operational model to the controller and the controller is configured to change the state of one or more operational systems as indicated by the operational model during the scheduled process.

Embodiment 17

The system of embodiment 14, wherein the logic device is configured to send the operational model to an interface for review by a human operator.

Embodiment 18

The system of embodiment 17, wherein the controller is configured to change states of the operational systems according to the operational model unless the operational model is aborted by the human operator.

Embodiment 19

The system of embodiment 5, wherein the logic device is configured to predict a change in bottom hole pressure based on the pressure data.

Embodiment 20

The system of embodiment 19, wherein the logic device is configured to generate an operational model based on a predicted change in bottom hole pressure.

Embodiment 21

The system of embodiment 20, wherein the logic device is configured to send an instruction to a controller based on the operational model, and the controller is configured to change the state of one or more operational systems according to the instruction.

Embodiment 22

The system of embodiment 21, wherein the logic device is configured to send the operational model to the controller and the controller is configured to change the state of one or more operational systems according to the instruction.

Embodiment 23

The system of embodiment 19, wherein the logic device is configured to predict a change in bottom hole pressure by comparing pressure data to historical pressure data.

Embodiment 24

The system of embodiment 1, wherein historical pressure data is stored on a memory device and the logic device is configured to access the historical pressure data at the memory device.

Embodiment 25

A method of conducting subterranean operations comprising:

monitoring at least one criterion of a plurality of operational systems selected from the group of choke valves, mud pumps, drawworks, backpressure pumps, top drive, mud gas separator, flow line, blowout preventer, inside blowout preventer, or any combination thereof; and sending the at least one criterion to a logic device configured to generate a capacity value for each operational system based on the at least one criterion; and changing a state of one or more of the plurality of the operational systems to control a downhole pressure.

Embodiment 26

The method of embodiment 25, wherein monitoring includes measuring at least one criterion of the plurality of operational systems, wherein the at least one criterion includes a wear status, a position, operational status, or any combination thereof.

Embodiment 27

The method of embodiment 26, wherein the plurality of operational systems are selected from the group including choke valves, mud pumps, backpressure pumps, blowout preventer, inside blowout preventer, and combinations thereof.

Embodiment 28

The method of embodiment 25, wherein the monitoring system comprises a plurality of components selected from the group consisting of pressure sensors, flow sensors, RPM indicators, weight indicators, choke position indicators, PVT (pit-volume totalizer) system, downhole sensors, and combinations thereof.

Embodiment 29

The method of embodiment 25, wherein monitoring further includes gathering pressure data from a plurality of sensors in a plurality of flow lines configured to contain and move fluid around the subterranean operation.

Embodiment 30

The method of embodiment 29, wherein monitoring includes sending the pressure data to the logic device.

Embodiment 31

The method of embodiment 30, wherein the logic device compares the capacity value of each of the operational systems to the pressure data and develops an operational model.

Embodiment 32

The method of embodiment 31, wherein the logic device generates an instruction based on the operational model, and the instruction is sent to a controller configured to control one or more of the operational systems.

Embodiment 33

The method of embodiment 31, wherein the logic devices sends the operational model to a controller.

Embodiment 34

The method of embodiment 31, wherein the operational model is configured to control a downhole pressure.

Embodiment 35

The method of embodiment 31, wherein the logic device is configured to send the operational model to an interface for review by a human operator.

Embodiment 36

The method of embodiment 35, wherein a controller is configured to change states of the operational systems according to the operational model unless the operational model is aborted by the human operator.

Embodiment 37

The method of embodiment 25, further comprising conducting a drilling event according to a process schedule.

Embodiment 38

The method of embodiment 37, wherein the one or more drilling events are selected from the group consisting of a stuck pipe-packoff, stuck pipe-hole collapse, a differentially stuck pipe, a power loss, a mud gas separator high fluid level, a mud gas separator blow through, RCD RPM exceeding RPM rating, tripping, a surge, a swab, or any combination thereof.

Embodiment 39

The method of embodiment 37, wherein conducting a drilling event includes sending a process signal from a controller to the logic device, wherein the process signal contains information identifying a drilling event.

Embodiment 40

The method of embodiment 39, wherein the logic device creates an operational model after receiving a process signal.

Embodiment 41

The method of embodiment 40, wherein the logic device sends an instruction to the controller based on the operational model, wherein the instruction includes instructions to a change of state for at least one of the operational systems.

Embodiment 42

The method of embodiment 40, wherein the logic devices sends the operational model to the controller and the controller changes change a state of at least one of the operational systems of the plurality of operational systems.

Embodiment 43

The method of embodiment 37, wherein the controller changes a state of at least one of the operational systems of the plurality of operational systems based on a process schedule.

Embodiment 44

The method of embodiment 40, wherein the logic device is configured to send the operational model to an interface for review by a human operator.

Embodiment 45

The method of embodiment 44, wherein the controller is configured to change states of the operational systems according to the operational model unless the operational model is aborted by the human operator.

Embodiment 46

The method of embodiment 25, further comprising predicting a change in the bottom hole pressure based on pressure data gathered by the monitoring system.

Embodiment 47

The method of embodiment 46, further comprising generating an operational model based on a predicted change in bottom hole pressure.

Embodiment 48

The method of embodiment 47, wherein the logic device is configured to send an instruction to a controller based on the operational model, and the controller is configured to change the state of one or more operational systems according to the instruction.

Embodiment 49

The method of embodiment 47, wherein the logic device is configured to send the operational model to a controller and the controller is configured to change the state of one or more operational systems according to the instruction.

Embodiment 50

The method of embodiment 46, wherein the logic device is configured to predict a change in bottom hole pressure by comparing pressure data to historical pressure data.

Embodiment 51

The method of embodiment 50, wherein historical pressure data is stored on a memory device and the logic device is configured to access the historical pressure data at the memory device.

Embodiments of the present invention are described generally herein in relation to drilling directional wells or unconventional wells, but it should be understood, however, that the methods and the apparatuses described may be equally applicable to other drilling environments. Further, while the descriptions and figures herein show a land-based drilling rig, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

What is claimed is:

1. A system for conducting subterranean operations comprising:

a monitoring system configured to monitor a pressure in a plurality of flow lines coupling together a plurality of operational systems selected from the group of choke valves, mud pumps, drawworks, backpressure pumps, top drive, mud gas separator, flow line, blowout preventer, inside blowout preventer, or any combination thereof; and a logic device configured to generate a capacity value for each operational system of the plurality of the operational systems based on the pressures as measured in the plurality of flow lines, and further configured to change a state of one or more of the plurality of the operational systems to control a downhole pressure by controlling fluid flow through each of a managed pressure drilling (MPD) choke, a rotating control device (RCD) utilizing at least one trip pump, and a top drive utilizing one or more mud or backpressure pumps.

2. The system of claim 1, wherein the monitoring system is further configured to monitor at least one criterion selected from the group of a wear status, a position, operational status, hydraulic modeling, sensor status, temperature, flow rate, density, rheology, or any combination thereof.

3. The system of claim 1, wherein the monitoring system is configured to send pressure data to the logic device, wherein the pressure data includes the pressure as measured within each of the flow lines of the plurality of flow lines.

4. The system of claim 3, wherein the logic device is configured to compare a capacity value of each of the operational systems to the pressure data and develop an operational model, wherein the operational model is configured to control a downhole pressure.

5. The system of claim 4, wherein the operational model includes changes to one or more of the plurality of operational systems to control the downhole pressure for one or more drilling events, selected from the group consisting of a stuck pipe-packoff, stuck pipe-hole collapse, a differentially stuck pipe, a power loss, a mud gas separator high fluid level, a mud gas separator blow through, a rotating control device (RCD) revolutions per minute RPM exceeding an RPM rating, tripping, connecting pipe, a surge, a swab, or any combination thereof.

6. The system of claim 5, wherein the logic device is configured to send one or more instructions to a controller based on the operational model.

7. The system of claim 6, wherein the controller is configured to change a state of at least one of the operational systems based on the one or more instructions.

8. The system of claim 7, wherein the controller is configured to send a process signal to the logic device, wherein the process signal contains information identifying a scheduled process.

9. The system of claim 8, wherein the logic device is configured to send an instruction to the controller, wherein the controller is configured to change a state of one or more operational systems during the scheduled process.

10. The system of claim 9, wherein the logic device is configured to send the operational model to the controller, and wherein the controller is configured to change the state of one or more operational systems as indicated by the operational model during the scheduled process.

11. The system of claim 4, wherein the logic device is configured to predict a change in bottom hole pressure based on the pressure data, and wherein the logic device is configured to generate an operational model based on a predicted change in the bottom hole pressure.

12. The system of claim 11, wherein the logic device is configured to send an instruction to a controller based on the operational model, and wherein the controller is configured to change a state of one or more operational systems according to the instruction.

13. The system of claim 11, wherein the logic device is configured to predict a change in the bottom hole pressure by comparing the pressure data to historical pressure data.

14. A method of conducting subterranean operations comprising:

monitoring a pressure in a plurality of flow lines coupling together a plurality of operational systems selected from the group of choke valves, mud pumps, draw-works, backpressure pumps, top drive, mud gas separator, flow line, blowout preventer, inside blowout preventer, or any combination thereof;

sending the pressures as measured in the plurality of flow lines to a logic device and generating a capacity value for each operational system based on the pressures as measured in the plurality of flow lines; and changing a state of one or more of the plurality of the operational systems to control a downhole pressure by controlling fluid flow through a managed pressure drilling (MPD) choke, a rotating control device (RCD) utilizing at least one trip pump, and a top drive utilizing one or more mud or backpressure pumps.

15. The method of claim 14, wherein monitoring further comprises measuring at least one additional criterion of the plurality of operational systems, wherein the at least one additional criterion includes a wear status, a position, operational status, or any combination thereof.

16. The method of claim 15, wherein monitoring further includes gathering the pressure data from a plurality of sensors in the plurality of flow lines configured to contain and move fluid around the subterranean operation, and sending the pressure data to the logic device.

17. The method of claim 16, wherein the logic device compares the capacity value of each of the operational systems to the pressure data, develops an operational model, and generates an instruction based on the operational model, wherein the instruction is sent to a controller configured to control one or more of the plurality of operational systems, and wherein the operational model is configured to control a downhole pressure.

18. The method of claim 14, further comprising conducting a drilling event selected from the group consisting of a stuck pipe-packoff, stuck pipe-hole collapse, a differentially stuck pipe, a power loss, a mud gas separator high fluid level, a mud gas separator blow through, RCD RPM exceeding RPM rating, tripping, a surge, a swab, or any combination thereof according to a process schedule.

19. The method of claim 18, wherein the logic device creates an operational model after receiving a process signal, and sends an instruction to a controller based on the operational model, wherein the instruction includes instructions to change a state of at least one of the operational systems, and wherein the controller is configured to change the state of one or more operational systems according to the instruction.

* * * * *